United States Patent [19]

Akesaka

[11] Patent Number: 4,691,787

[45] Date of Patent: Sep. 8, 1987

[54] EARTH AUGER

[75] Inventor: Toshio Akesaka, Yokohama, Japan

[73] Assignee: Kabushiki Kaisha Iseki Kaihatsu Koki, Tokyo, Japan

[21] Appl. No.: 830,842

[22] Filed: Feb. 19, 1986

[51] Int. Cl.[4] ..... B23Q 5/33

[52] U.S. Cl. ..... 173/145; 173/159; 173/160; 175/203; 408/137

[58] Field of Search ..... 173/145, 159, 146, 148, 173/160, 152, 19; 408/134, 137; 175/121, 203, 173

[56] References Cited

U.S. PATENT DOCUMENTS

| | | | |
|---|---|---|---|
| 2,090,330 | 8/1937 | Jones | 173/146 |
| 2,930,587 | 3/1960 | Seawright | 173/145 |
| 2,999,550 | 9/1961 | Gerentes | 173/146 |
| 3,955,629 | 5/1976 | Turner | 173/146 |
| 4,201,271 | 5/1980 | Evans | 173/146 |

*Primary Examiner*—E. R. Kazenske
*Assistant Examiner*—Hien H. Phan
*Attorney, Agent, or Firm*—Stephen F. K. Yee

[57] ABSTRACT

An earth auger is provided which can be compacted, lightened and adjusted with respect to feed speed according to geology. The earth auger has a screw having a spiral blade provided with notches arranged axially linearly. A first rotary member and a second rotary member arranged coaxially in a case for the screw and surrounding partially the screw are disposed rotatably about the axis. The first rotary member has a key engaging the notches of the screw, and the second rotary member has a thread groove meshing with the blade of the screw. The first and the second rotary members are rotated respectively in any one of forward and backward directions through a drive mechanism. The screw is rotated by at least one of rotational operations of the first and the second rotary members to advance or retreat relative to the case for excavating.

6 Claims, 5 Drawing Figures

EARTH AUGER

BACKGROUND OF THE INVENTION

1. Field of the Invention:

This invention relates to an earth auger, and more paticularly, to an earth auger which can be used for excavating a general water well or the like in addition to boring for an anchor engineering method and a grout pouring hole.

2. Description of the Prior Art:

The earth auger conventionally used has a screw having an upper end coupled with a swivel reduction gear in which a vertical type motor is incorporated to rotate the screw and bore while lowering the screw along a leader.

On the other hand, a boring machine rotates a drill extending through a swivel head rotated by a bevel gear to bore while giving a feed to the drill.

Since the earth auger bores with the screw, it has a small excavating reaction compared with the boring machine. On the other hand, since it is provided on the upper end with a drive source, it needs a leader for guiding the screw and resules in a large size as a whole. Also, since the screw is fed by its own weight, it is difficult to change the feed speed according to soil quality.

Since the boring machine has a large weight standing the excavating reaction, it is not easy to transport and not a convenient one.

SUMMARY OF THE INVENTION

An object of the present invention is to provide an earth auger capable of being compacted, lightened and adjusted at will with respect to the feed speed.

According to the present invention, an earth auger comprises a screw provided with a blade formed spirally around the axis and having notches arranged axially linearly; a case for the screw; a first rotary member supported rotatably about said axis in the case to surround partially said screw and having a key engaging said notches of said screw; a second rotary member disposed coaxially with said irst rotary member and supported rotatably about said axis in said case and having a thread groove meshing with said blade of said screw; and drive mechanisms for rotating said first and said second rotary members.

According to the present invention, since the earth auger is provided with the screw, case for the screw, and the first and the second rotary members supported in the case, it can be compacted and lightened as a whole and made convenient. Also, by selecting the rotating speed and/or the direction of rotation of the rotary members can be obtained any of feeding speed and optimum boring suited for geology.

BRIEF DESCRIPTION OF THE DRAWINGS

The other objects and features of the invention will become apparent from the following description of a preferred embodiment of the invention with reference to the accompanying drawings, in which.

DESCRIPTION OF THE PREFERRED EMBODIMENT

Figure 1:
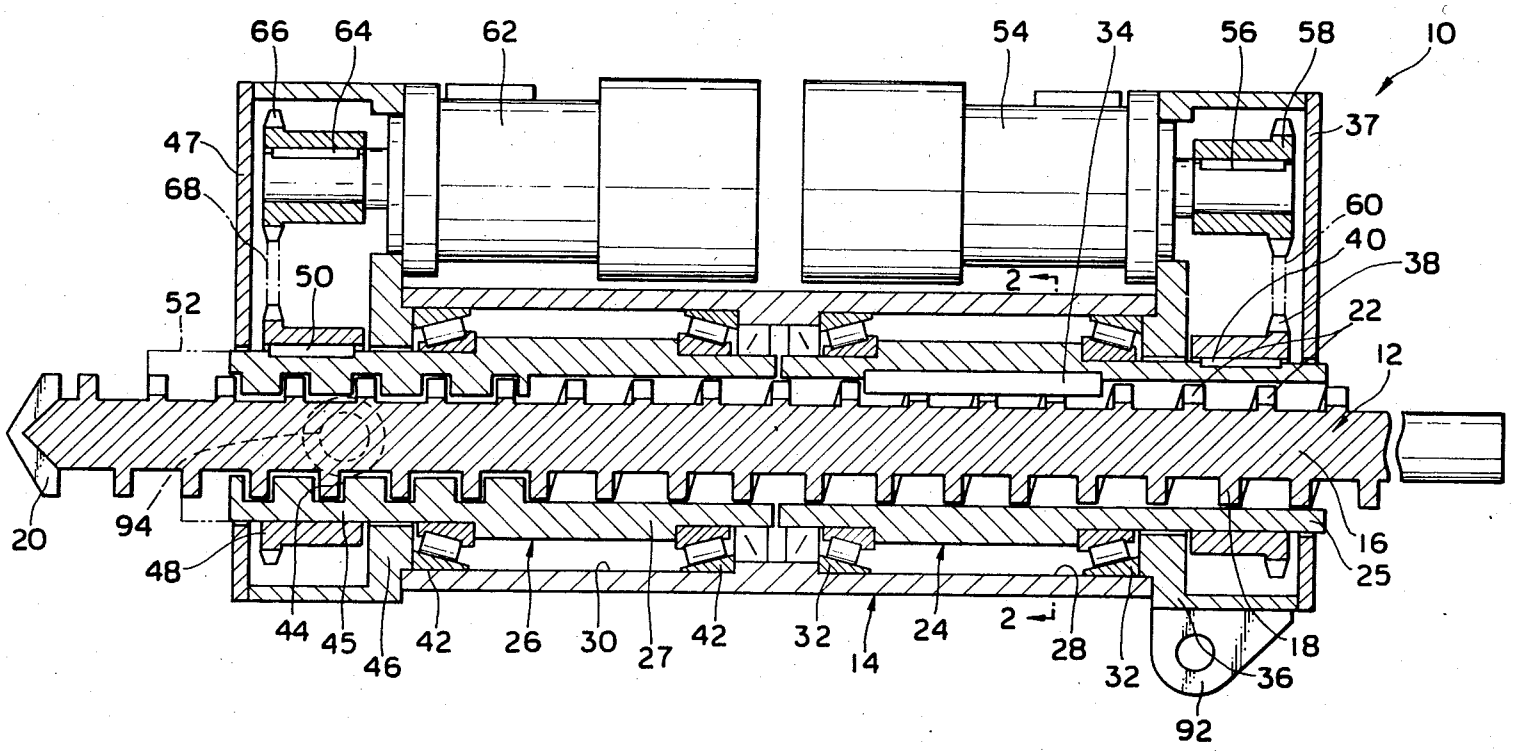
FIG. 1 is a sectional view showing an earth auger.

As shown in FIG. 1, an earth auger 10 comprises a screw 12 and a case 14 thereof.

The screw 12 is provided with a shaft 16, a blade 18 provided ono the shaft 16 and a bit 20 secured to the end of the shaft 16. As shown, the diameter of the bit 20 is substantially the same as the diameter of the blade 18. The blade 18 is of a tpe of so called trapezoidal thread (shown as right-hand thread in the embodiment) surrounding spirally the axis with a constant pitch. The blade 18 is provided with notches 22 axially in a row arranged to cover substantially the total length of the screw 12.

Figure 2:
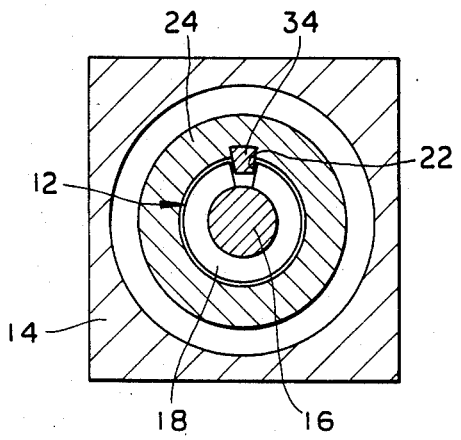
FIG. 2 is a sectional view taken along the line 2—2 in FIG. 1.

In the embodiment shown in FIGS. 1 and 2, while the notches 22 are axially arranged in a row, they may be provided in a plurality of rows. In the latter case, the notches 22 included in the respective rows are arranged linearly parallel to the axis.

The case 14 supports a first and a second rotary members 24,26 surrounding partially the screw 12. The case 14 is formed of a member having a square section in the embodiment shown and provided with two holes 28,30 bored from two end faces. Usually, the case 14 is mounted on a support member 90 (FIG. 5) as will be desribed later, while in a special case the weight of the case itself is increased to stand the excavating reaction so that the support member 90 may be omitted.

The first rotary member 24 is generally cylindrically formed and attached rotatably to the hole 28 of the case 14 through a pair of roller bearings 32 contacting an outer surface of the first rotary member 24. A key 34 extending in said axial direction is fitted in an inner surface of the first rotary member 24 to engage the notches 22 provided in the blade of the screw 12. As a result, the screw 12 can be rotatably driven through the key 34 and moved axially along the key 34.

The first rotary member 24 has on the end a guide portion 25. In the embodiment shown, the guide portion 25 projects slightly in said axial direction from a gear box 36 bolted (not shown) on one end of the case 14 and partially surrounding the guide portion 25 to prevent the screw 12 from deflection while receiving a turning force through a sprocket 38 connected with the guide portion 25 by a key 40 extending in said axial direction on an outer surface of the guide portion 25 to rotate thus the first rotary member 24. The second rotary member 26 is generally cylindrically formed and attached rotatably to a hole 30 in the case 14 through a pair of roller bearings 42 contacting an outer surface of the second rotary member 26. The second rotary member 26 is provided on a portion of the inside with a thread groove 44. The thread groove 44 has the same pitch as the blade 18 of the screw 12. The second rotary member 26 is supported in the case 14 with the thread groove 44 meshing with the blade 18.

In the embodiment shown, the portion 45 provided with the thread groove 44 projects slightly in said axial direction from a gear box 46 bolted (not shown) to the other end of the case 14 and surrounding partially the portion 45. The portion 45 is connected to a sprocket 48 through a key 50 extending in said axial direction on an outer surface of the portion. The second rotary member 26 has a guide portion 27 to prevent the screw 12 from deflection.

The second rotary member 27 is preferably disposed at the earth side of the first rotary member 24. That is, when the earth auger 10 is used and constituted such that the second rotary member 26 is at the side near the earth and the first rotary member 24 is at the side remote from the earth, earth and sand carried by the blade 18 of the screw 12 in use can be scraped off in the proximity of the gear box 46 by a scraper 52 rotated integrally with the second rotary member 26. The scraper 52 in this case is provided with a screw having the same pitch as the thread groove 44.

Figure 3:
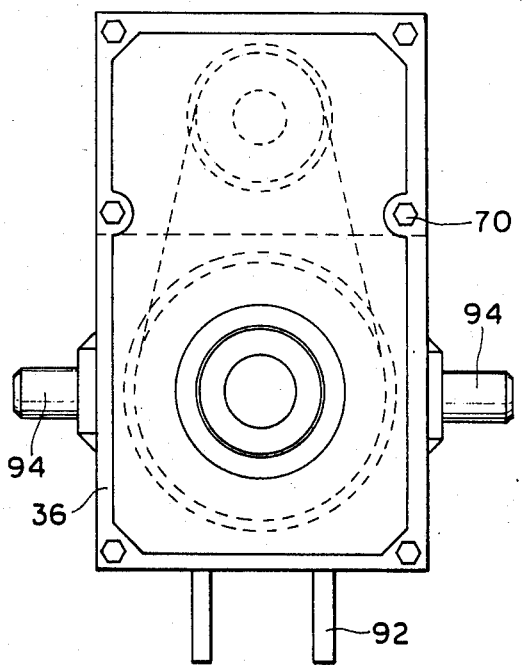
FIG. 3 is a right side view of the auger.

A hydraulic motor 54 is mounted on the gear box 36. A sprocket 58 is secured to an output shaft of the hydraulic motor 54 by a key 56. A chain 60 is trained over the sprocket 58 and the sprocket 38, and the hydraulic motor 54 constitutes a drive mechanism for the first rotary member 24 together with the sprockets 38,58 and the chain 60. On the other hand, a hydraulic motor 62 is mounted on the gear box 46, and a sprocket 66 is secured to an output shaft of the hydraulic motor 62 by a key 64. A chain 68 is trained over the sprocket 66 and the sprocket 48 and the hydraulic motor 62 constitutes a drive mechanism for the second rotary member 26 together with the sprockets 48,66 and the chain 68. Covers 37,47 are mounted respectively on the gear boxes 46,46 by bolts 70 (FIG. 3).

When the drive source, i.e., the hydraulic motor 54 for the first rotary member 24 and the drive source, i.e., hydraulic motor 62 for the second rotary member 26 are individually provided as in the embodiment shown, the first and the second rotary members 24,26 are preferably easy to control as will be later described, while both members may be driven by a single hydraulic motor. In the latter case, the hydraulic motor provided with a clutch or the like may be used.

Figure 4:
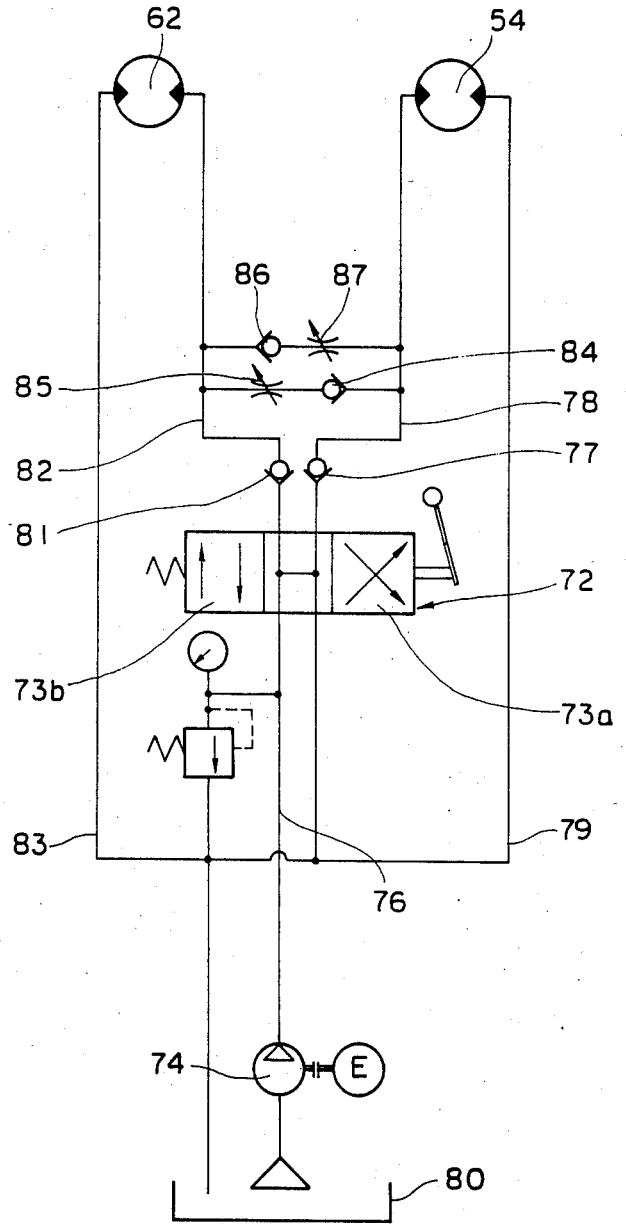
FIG. 4 is a hydraulic circuit diagram.

As shown in FIG. 4, the hydraulic motors 54,62 are connected to a hydraulic pump 74 through a manual change-over valve 72. When the change-over valve 72 is changed over from the neutral position shown in the drawing to a first port 73*a*, pressurized oil supplied from the hydraulic pump 74 is sent to the hydraulic motor 54 through a piping 76, the change-over valve 72 and a check valve 77 incorporated in a piping 78 and then returned to a reservoir tank 80 from a piping 79. Also, when the change-over valve 72 is changed over to a second port 73*b*, pressurized oil supplied from the hydraulic pump 72 is sent to the hydraulic motor 62 through the piping 76, the change-over valve 72 and a check valve 81 incorporated in a piping 82 and then returned from a piping 83 to the reservoir tank 80.

In the embodiment shown, a bypass is provided which is connected from the piping 78 to the piping 82 through a check valve 84 and a variable throttle valve 85 and further from the piping 82 to the piping 78 through a check valve 86 and a variable throttle valve 87.

Figure 5:
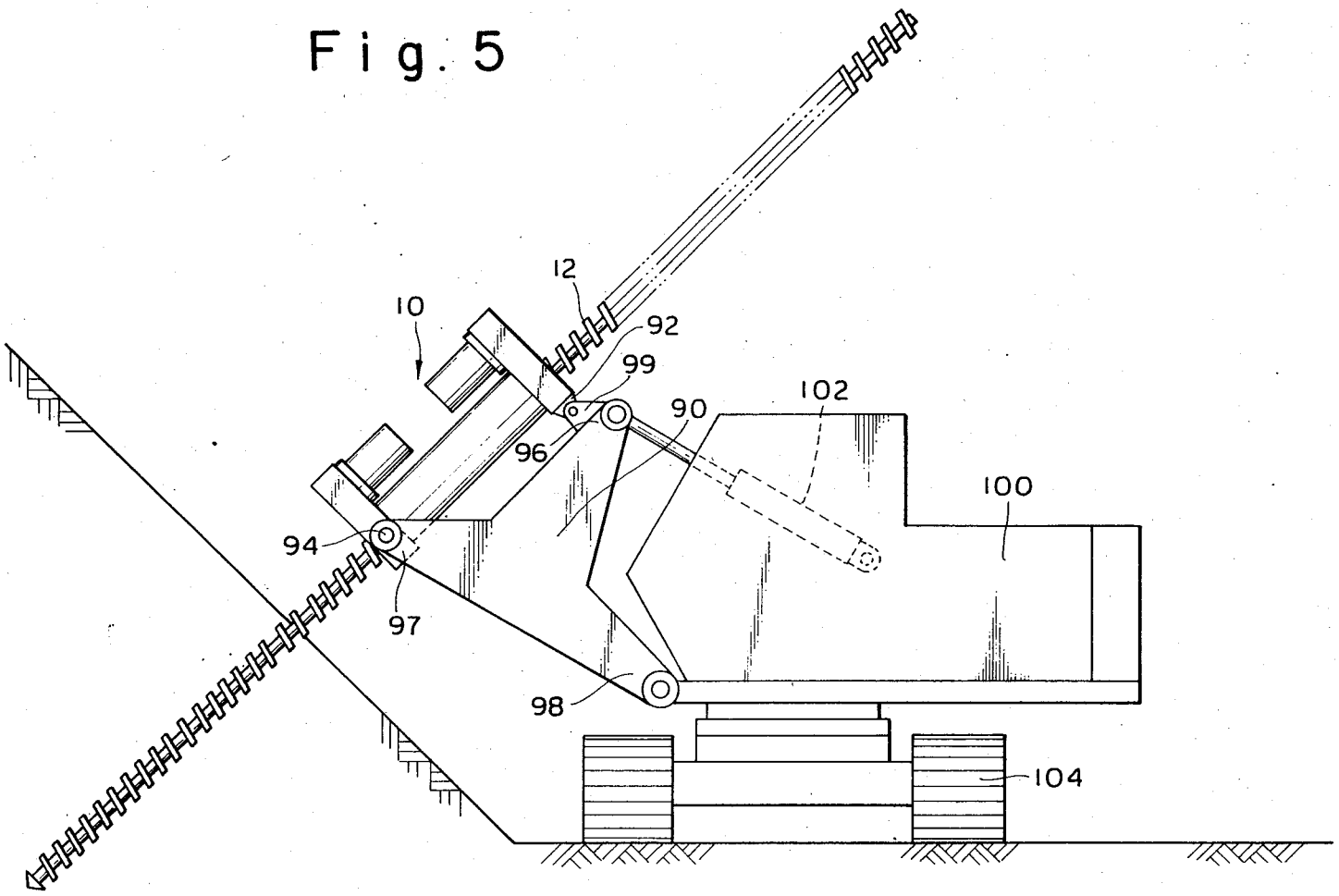
FIG. 5 is a front view showing the condition of use.

The earth auger 10 is mounted for use on a support member 90 as shown in FIG. 5 for example.

Brackets 92 (FIG. 3) and a pair of shafts 94 are provided respectively in the gear boxes 36,46. On the other hand, the support member 90 consists of two plate materials spaced from each other in the direction perpendicular to the drawing and has three pivotal portions 96,97 and 98. A bracket 99 projecting from the pivotal portion 96 is inserted between the brackets 92 and connected pivotably to both brackets. The shaft 94 is fitted in the pivotal portion 97. Further, the pivotal portions 96,98 of the support member are connected pivotably to hydraulic cylinders 102 of a turning bed 100 and the turning bed 100 respectively. The turning bed 100 can be moved by a crawler 104. The support member may be a leader of prior earth auger, movable truck, frame bed, etc. other than that shown in FIG. 5.

While the first rotary member 24 is rotated clockwise (as viewed in the progressing direction of the screw 12. The same shall apply hereinafter) with the second rotary member26 kept stationary, since the blade 18 is fed by the thread groove 44 of the second rotary member 26, the screw 12 advances to bore a natural ground. The feed speed then is $P \times N$, where P is pitch of thread and N is rotational speed.

The first rotary member 24 is rotated clockwise and the second rotary member 26 is rotated clockwise at lower speed. Then, the screw 12 is rotated by the first rotary member 24 and the blade 18 is fed by the thread groove 44 of the second rotary member 26, so that the screw 12 is delayed by the rotational amount of the second rotary member 26 through it advances. Thus, the feed speed at that time is $P \times N \times \alpha (\alpha < 1)$. When the rotation of the second rotary member 26 has the same speed as the first rotary member 24, the feed speed of the screw 12 is zero.

The first rotary member 24 is kept stationary and the second rotary member 26 is rotated clockwise, or the first rotary member 24 is rotated counterclockwise and the second rotary member 26 is kept stationary. Thus, since the blade 18 is returned by the screw 44 of the second rotary member 26, the screw 12 retreats to be withdrawn from the natural ground. The withdrawing speed then is $P \times N$.

The first rotary member 24 is rotated counterclockwise and the second rotary member 26 is rotated counterclockwise at lower speed. Then, the screw 12 is rotated by the first rotary member 24 and the blade 18 is returned by the thread groove 44 of the second rotary member 26 so that the screw 12 is delayed by the rotational amount of the second rotary member 26 though it retreats. Thus, the withdrawing speed then is $P \times N \times \alpha$. When the rotational speed of the second rotary member 26 is equalized to that of the first rotary member 24, the withdrawing speed of the screw 12 is zero.

When the first rotary member 24 is rotated clockwise and the second rotary member 26 is rotated counterclockwise, the advancing speed of the screw 12 is larger than $P \times N$. Reversely, when the first rotary member 24 is rotated counterclockwise and the second rotary member 26 is rotated clockwise, the retreating speed of the screw 12 is larger than $P \times N$.

What is claimed is:

1. An earth auger comprising:

a drilling screw for cutting into and excavating earth, having a shaft portion, a blade portion formed spirally around said shaft portion, a bit portion secured to one end of said shaft portion and having substantially the same diameter as said blade portion, and notches arranged axially linearly on said blade portion;

a case for the screw;

a first rotary member supported rotatably about said shaft portion in the case to surround partially said screw and having a key engaging said notches of said screw;

a second rotary member disposed coaxially with said first rotary member and supported rotatably about said shaft portion in said case and having a thread groove meshing with said blade of said screw; and drive mechanisms for rotating said first rotary member to rotate said screw and said second rotary member to move said screw along the longitudinal axis of the shaft portion.

2. An earth auger as claimed in claim 1, wherein a separate drive source for said first rotary member and a separate drive source for said second rotary member are independently provided.

3. An earth auger as claimed in claim 1, wherein said second rotary member is disposed on the side of said one end of said shaft portion and said first rotary member is disposed on the side of the other end of said shaft portion.

4. An earth auger as claimed in claim 1, wherein each of said first and said second rotary members has a guide portion for preventing said screw from lateral deflection.

5. An earth auger as claimed in claim 1, wherein a support member for said case is provided.

6. An earth auger as claimed in claim 1, further comprising a scraper secured to said second rotary member and having the same pitch as said blade portion for removing earth from the screw.

* * * * *